US011912482B2

(12) United States Patent
Miyaji et al.

(10) Patent No.: US 11,912,482 B2
(45) Date of Patent: Feb. 27, 2024

(54) CLIPS

(71) Applicant: DAIWA KASEI KOGYO KABUSHIKI KAISHA, Okazaki (JP)

(72) Inventors: Jyun Miyaji, Okazaki (JP); Syouji Yamashita, Okazaki (JP)

(73) Assignee: DAIWA KASEI KOGYO KABUSHIKI KAISHA, Okazaki (JP)

( * ) Notice: Subject to any disclaimer, the term of this patent is extended or adjusted under 35 U.S.C. 154(b) by 0 days.

(21) Appl. No.: 17/524,563

(22) Filed: Nov. 11, 2021

(65) Prior Publication Data

US 2022/0144513 A1 May 12, 2022

(30) Foreign Application Priority Data

Nov. 11, 2020 (JP) ..... 2020-187826

(51) Int. Cl.
*B65D 63/10* (2006.01)

(52) U.S. Cl.
CPC ..... *B65D 63/1081* (2013.01)

(58) Field of Classification Search
CPC ..... B65D 63/1081; B65D 2563/108; F16B 37/0857; F16L 3/233; F16L 3/2332; F16L 3/2334; F16L 3/2336; F16L 3/2338
USPC ..... 24/16 PB
See application file for complete search history.

(56) References Cited

U.S. PATENT DOCUMENTS 5,926,921 A * 7/1999 Benoit ..... B65D 63/1072 24/17 AP
7,008,160 B2 * 3/2006 Kanie ..... F16L 3/223 411/433
7,437,804 B1 * 10/2008 Geiger ..... F16L 3/237 248/74.3
7,774,905 B2 * 8/2010 Geiger ..... F16L 3/2332 248/74.3
8,914,952 B2 * 12/2014 Wakabayashi ..... F16B 37/0842 248/68.1
10,323,774 B2 * 6/2019 Van Hulst ..... H02G 3/32
2008/0066265 A1 * 3/2008 Pilon ..... B65D 63/1081 24/16 PB

FOREIGN PATENT DOCUMENTS

JP 2524861 Y2 2/1997

* cited by examiner

*Primary Examiner* — Jack W Lavinder
(74) *Attorney, Agent, or Firm* — Diamantis Law

(57) ABSTRACT

A clip comprising a connecting base including a bolt introduction hole that is configured such that a bolt member formed on an object member is introduced thereinto. The connecting base includes flexible engagement strips formed on an inner surface thereof and having pressing blocks. The pressing blocks respectively include engagement claws formed on proximal end portions of inner surfaces thereof. The engagement claws engage the predetermined portions of thread groove of the bolt member, so that the connecting base is connected to the object member. In a connected condition of the connecting base, when the engagement claws are disengaged from the predetermined portions of the thread groove due to an extraction force, edge portions formed on distal end portions of the inner surfaces of the pressing blocks engage different portions of the thread groove of the bolt member.

8 Claims, 18 Drawing Sheets

CLIPS

CROSS-REFERENCE TO RELATED APPLICATIONS

This application claims priority to a Japanese Patent Application serial number 2020-187826 filed Nov. 11, 2020, the contents of which are incorporated herein by reference.

BACKGROUND

The disclosure relates generally to a cable tie or clip. More specifically, the disclosure relates to a cable tie or clip including a holding base that is configured to hold an attaching article (e.g., an electric component such as a wiring harness), and a connecting base that is configured to be connected to a bolt formed on an object member (e.g., a panel of a vehicle).

A various types of clips that are configured to attach a wiring harness (an attaching article) to an object member (e.g., a vehicle body) are already known. As shown in FIGS. 16 to 19, a known clip 401 includes a holding base 410 that is configured to hold a wiring harness (not shown), and a connecting base 420 that is configured to be connected to a bolt 404 formed on an object member 403 and having a thread 404*a* and a thread groove 404*b*. The holding base 410 includes a buckle 411, and a belt 412 integrated with the buckle 411 and having a plurality of rack teeth 413 formed thereon. The buckle 411 has a belt insertion hole 415 formed therein and an engagement claw (not shown) formed on an inner surface thereof and projecting into the belt insertion hole 415. The belt insertion hole 415 is configured such that the belt 412 is inserted thereinto. The engagement claw of the buckle 411 is configured to engage the rack teeth 413 of the belt 412 when the belt 412 is inserted into the belt insertion hole 415 of the buckle 411. Conversely, the connecting base 420 is integrated with the buckle 411 of the holding base 410. The connecting base 420 has a bolt introduction (insertion) hole 422 formed thereon and a pair of engagement strips 424 formed on an inner surface thereof and having engagement claws 427. The bolt introduction hole 422 is configured such that the bolt 404 is introduced (inserted) thereinto. The engagement strips 424 oppositely project toward a center of the bolt introduction hole 422 such that the engagement claws 427 engage the thread groove 404*b* of the bolt 404 when the bolt 404 is introduced into the bolt introduction hole 422. Further, such a structure of the connecting base 420 is taught by, for example, Japanese Utility Model Registration No. 2524861.

In order to attach the wiring harness (not shown) to the object member 403 using the clip 401, first, the belt 412 of the holding base 410 is looped and wrapped around the wiring harness and is then inserted into the belt insertion hole 415, so as to engage the rack teeth 413 of the belt 412 with the engagement claw of the buckle 411. Thus, the clip 401 is attached to the wiring harness in a condition in which the wiring harness is clamped or held by the holding base 410. Thereafter, the connecting base 420 is pressed to the bolt 404 formed on the object member 403. As a result, the bolt 404 is introduced into the bolt introduction hole 422 of the connecting base 420 while oppositely flexing the engagement strips 424 of the connecting base 420 in a direction away from each other due to contact of the thread 404*a* of the bolt 404 with the engagement claws 427. When the bolt 404 is completely introduced into the bolt introduction hole 422 of the connecting base 420, the engagement claws 427 of the engagement strips 424 engage predetermined portions of the thread groove 404*b* of the bolt 404 corresponding thereto, so that the connecting base 420 is connected to the object member 403 (FIG. 17). Thus, the clip 401 is attached to the object member 403 via the bolt 404. As a result, the wiring harness is attached to the object member 403 via the clip 401.

Generally, when an extraction force is applied to the connecting base 420 of the clip 401 in a condition in which the clip 401 is attached to the object member 403, the engagement strips 424 of the connecting base 420 are oppositely flexed in a direction toward each other due to contact of the thread 404*a* of the bolt 404 with the engagement claws 427 (FIG. 18). Further, the extraction force is successively applied to the connecting base 420 of the clip 401, the engagement strips 424 are compressed or deformed while being flexed in the direction toward each other. As a result, the engagement claws 427 of the engagement strips 424 are disengaged from the corresponding portions of the thread groove 404*b* of the bolt 404 (FIG. 19). Due to disengagement of the engagement claws 427, the connecting base 420 may be disconnected from the object member 403. As a result, the clip 401 may be separated from the object member 403. Thus, the wiring harness may be separated from the object member 403 with the clip 401.

Therefore, there is a need in the art for an improved clip.

SUMMARY

In one aspect of the present disclosure, a clip may include a holding base configured to hold an attaching article, and a connecting base integrated with the holding base and including a bolt introduction hole that is configured such that a bolt member formed on an object member is introduced thereinto. The connecting base includes flexible engagement strips formed on an inner surface thereof and having pressing blocks formed on distal ends thereof. The engagement strips are oppositely projected from the inner surface of the connecting base toward a center of the bolt introduction hole. The pressing blocks respectively include engagement claws formed on proximal end portions of inner surfaces thereof and configured to engage predetermined portions of a thread groove of the bolt member when the bolt member is introduced into the bolt introduction hole. When the bolt member is introduced into the bolt introduction hole, the engagement claws engage the predetermined portions of the thread groove of the bolt member, so that the connecting base is connected to the object member. In a connected condition in which the connecting base is connected to the object member, even when the engagement strips are flexed due to an extraction force applied to the connecting base, thereby disengaging the engagement claws from the predetermined portions of the thread groove of the bolt member, edge portions formed on distal end portions of the inner surfaces of the pressing blocks engage different portions of the thread groove of the bolt member that are positioned away from the predetermined portions of the thread groove corresponding to the engagement claws in a direction toward a distal end of the bolt member.

According to this aspect, even when an extraction force is applied to the connecting base (the clip) in a condition in which the clip is attached to the object member, the clip is prevented from being separated from the object member. Therefore, the attaching article held by the clip is prevented from being separated from the object member.

Additional objects, features and advantages of the present disclosure will be readily understood after reading the following detailed description together with the accompanying drawings and the claims.

DETAILED DESCRIPTION

A detailed representative embodiment of the present disclosure will be described with reference to FIGS. 1 to 15.

Figure 1:
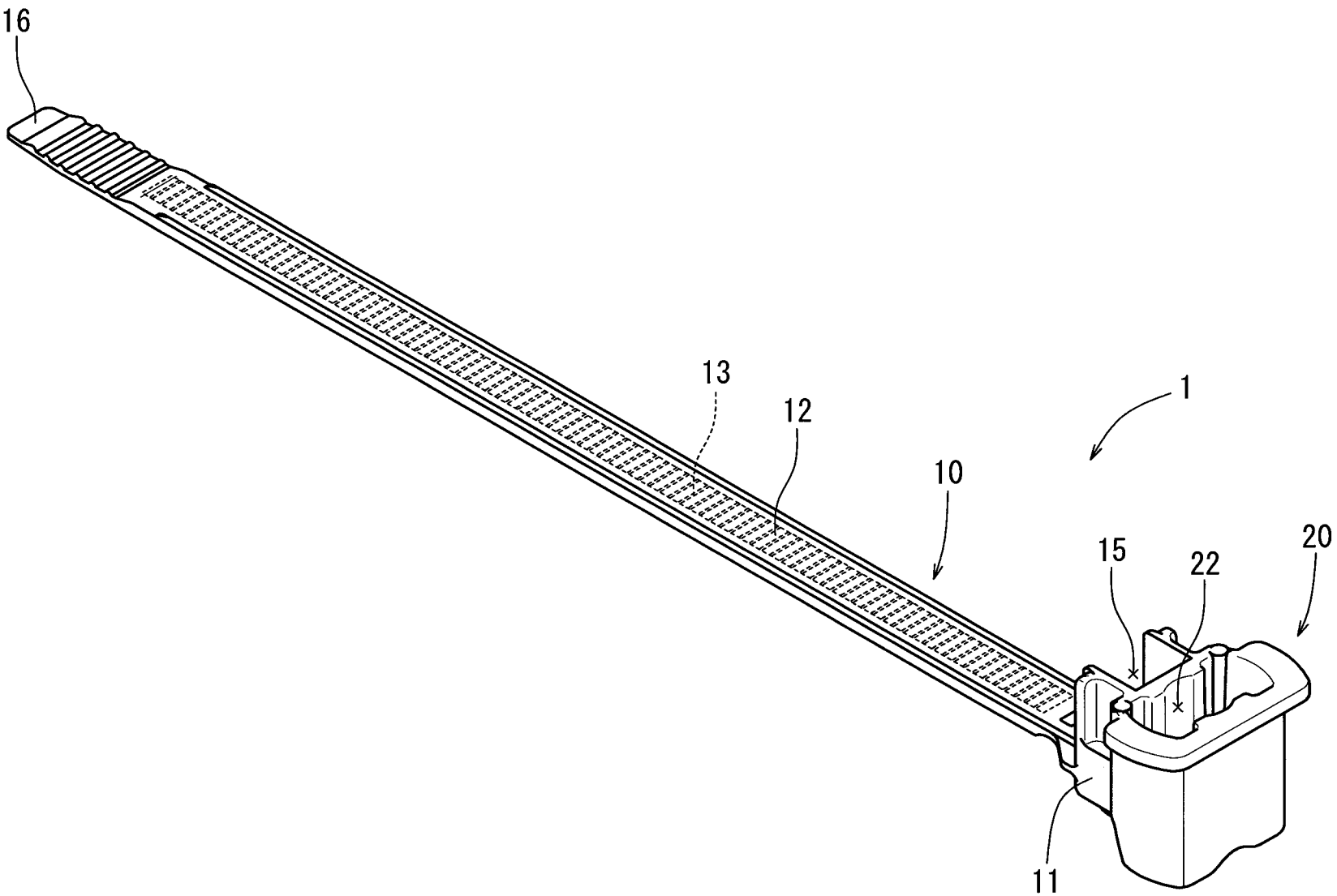
FIG. 1 is a perspective view of a clip according to a representative embodiment.

As shown in FIG. 1, a clip 1 may include a holding base 10 that is configured to hold an attaching article or wiring harness 2 (FIGS. 5 to 7), and a connecting base 20 that is configured to be connected to a bolt member or stud bolt 4 (FIGS. 8 to 12) formed on an object member 3 (e.g., a panel of a vehicle) and having a thread 4*a* and a thread groove 4*b* (FIGS. 8 to 12). The holding base 10 and the connecting base 20 may preferably be integrally formed by molding of a hard synthetic resin, e.g., PP (polypropylene). Further, the stud bolt 4 may be a standard stud bolt having an outer diameter of 5 mm (M5).

As shown in FIG. 1, the holding base 10 may include a buckle 11, and an elastic belt 12 integrated with the buckle 11 and having a plurality of engagement teeth or rack teeth 13. The rack teeth 13 may be formed on one (inner) surface of the belt 12 at a constant pitch distance in a longitudinal direction of the belt 12. The buckle 11 may have a belt insertion hole 15 formed thereon and an engagement claw 14 (FIG. 2) formed on an inner surface thereof and projecting into the belt insertion hole 15. The belt insertion hole 15 may be configured such that the belt 12 is inserted thereinto. The engagement claw 14 of the buckle 11 may be configured to engage the rack teeth 13 of the belt 12 when the belt 12 is inserted into the belt insertion hole 15 of the buckle 11.

Figure 2:
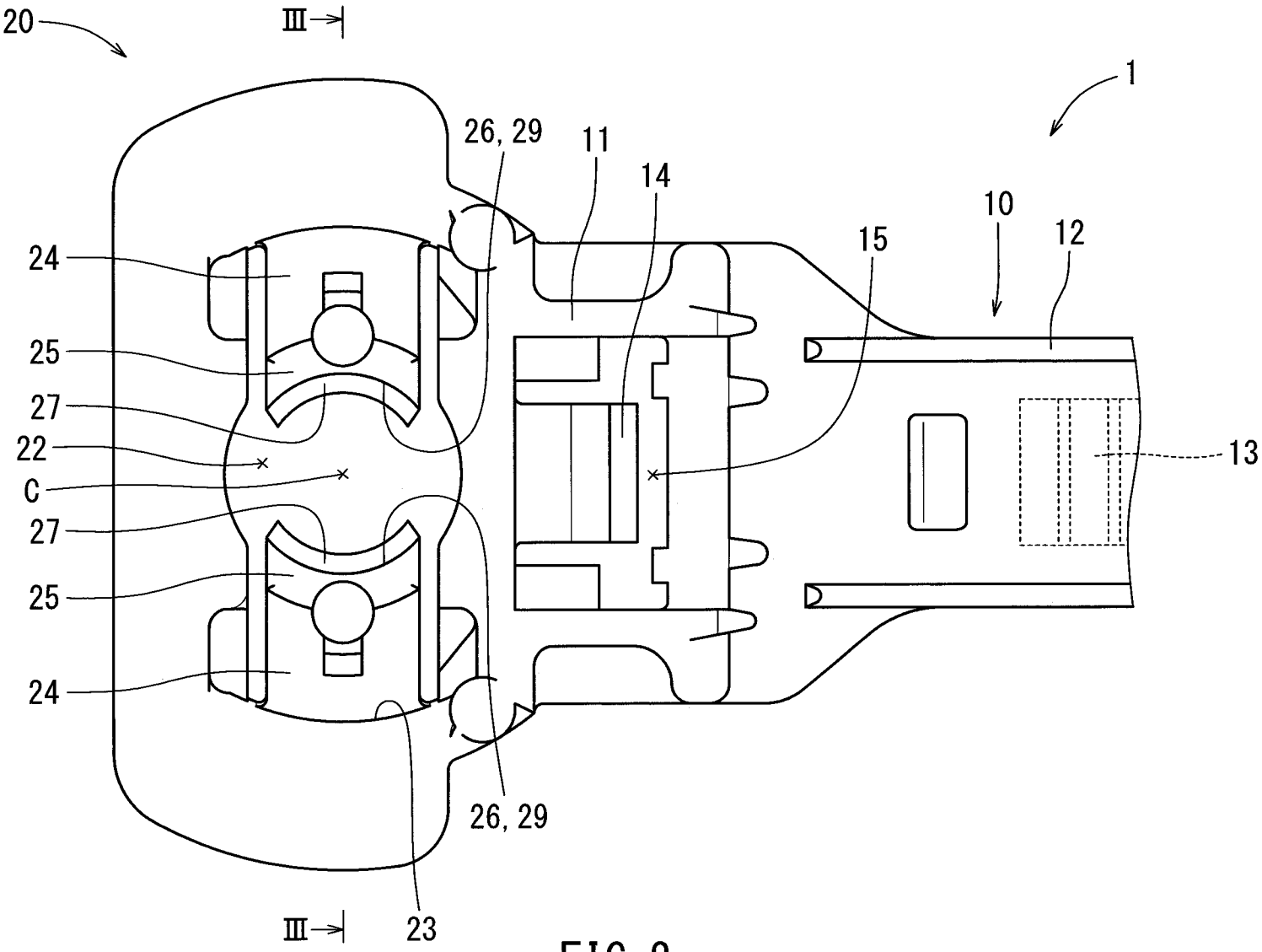
FIG. 2 is a partially enlarged plan view of the clip.
Figure 3:
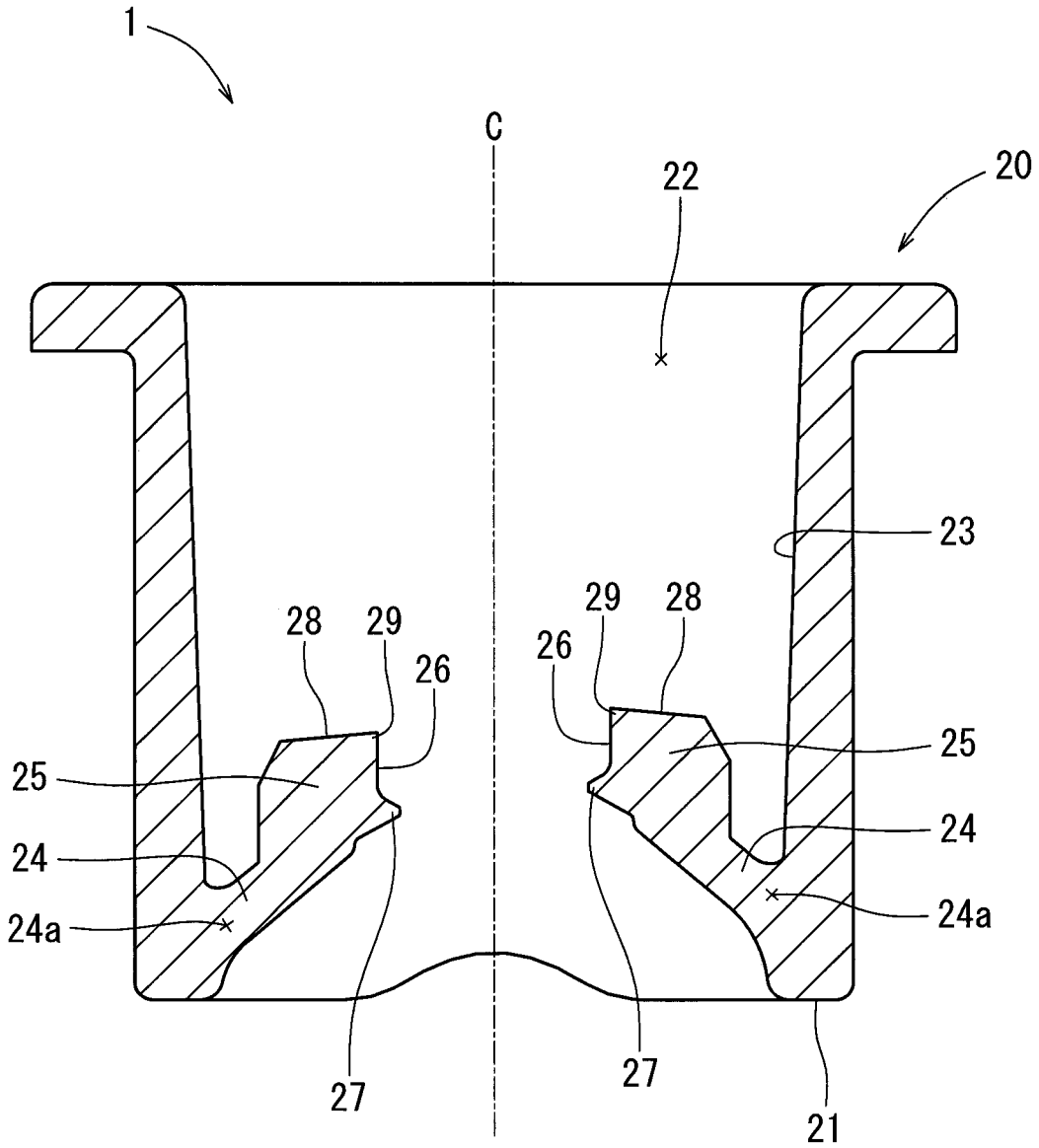
FIG. 3 is a cross-sectional view taken along line III-III in FIG. 2.

As shown in FIGS. 1 to 3, the connecting base 20 may be integrated with the buckle 11 of the holding base 10. The connecting base 20 may have a laterally elongated bolt introduction (insertion) hole 22 formed thereon and a pair of engagement strips 24 flexibly formed on an inner surface 23 thereof. The bolt introduction hole 22 may be configured such that the stud bolt 4 is introduced (inserted) thereinto. The engagement strips 24 may be laterally oppositely projected from the inner surface 23 of the connecting base 20 toward a center or center line C of the bolt introduction hole 22.

The engagement strips 24 may respectively have pressing blocks 25 formed on distal ends thereof, and (first) engagement claws 27 formed on the pressing blocks 25 and configured to engage the thread groove 4*b* of the stud bolt 4. The pressing blocks 25 may include vertical opposite inner surfaces 26 and upper horizontal end surfaces 28 intersecting with the inner surfaces 26. As shown in FIG. 2, the vertical surfaces 26 may preferably be formed as concave surfaces centered at the center line C of the bolt introduction hole 22 whereas the upper surface 28 may preferably be formed as flat surfaces. The engagement claws 27 may respectively be formed on proximal (lower) end portions (i.e., end portions closest to proximal ends 24*a* of the engagement strips 24) of the inner surfaces 26 of the pressing blocks 25. The engagement claws 27 may be formed as projections that are oppositely projected from the inner surfaces 26 of the pressing blocks 25. The engagement claws 27 may preferably have a wedge-shape in cross section. Further, as shown in FIG. 2, the engagement claws 27 may preferably have an arc-shape centered at the center line C of the bolt introduction hole 22. Therefore, the engagement claws 27 may reliably engage the thread groove 4*b* of the stud bolt 4 when the stud bolt 4 is introduced into the bolt introduction hole 22

Figure 4:
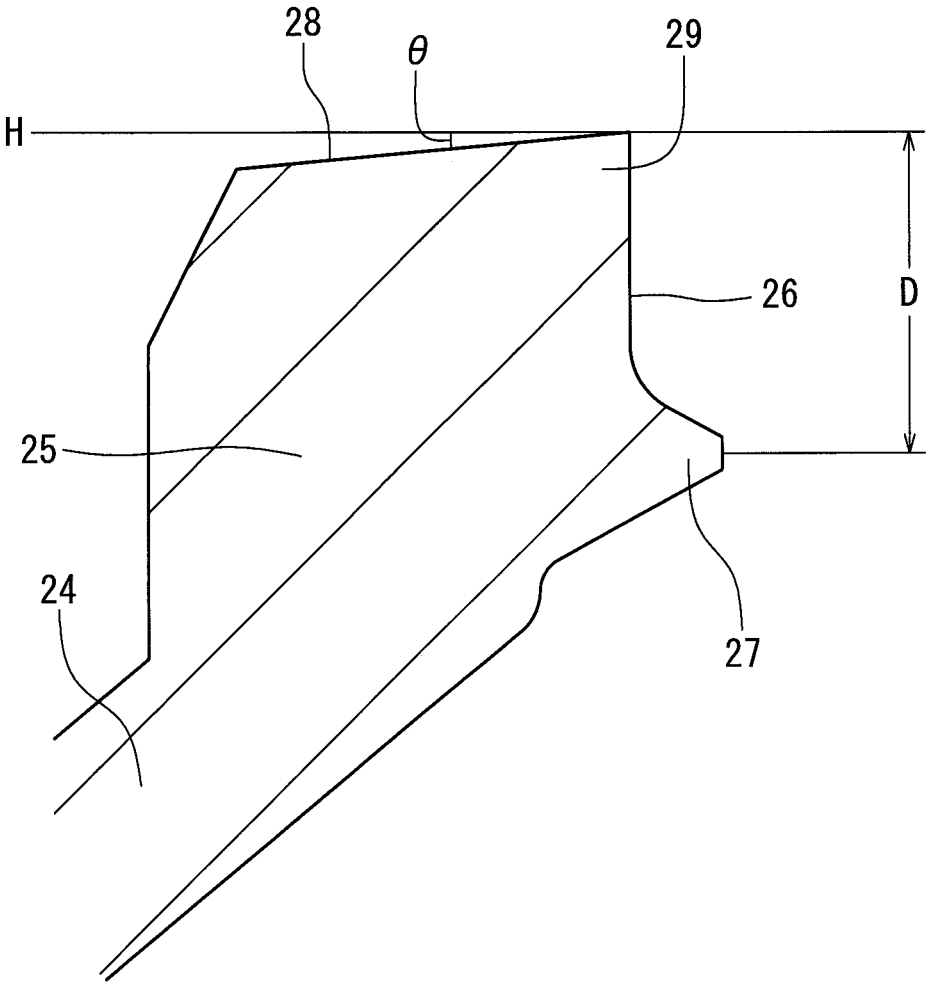
FIG. 4 is a partially enlarged view of FIG. 3.
Figure 5:
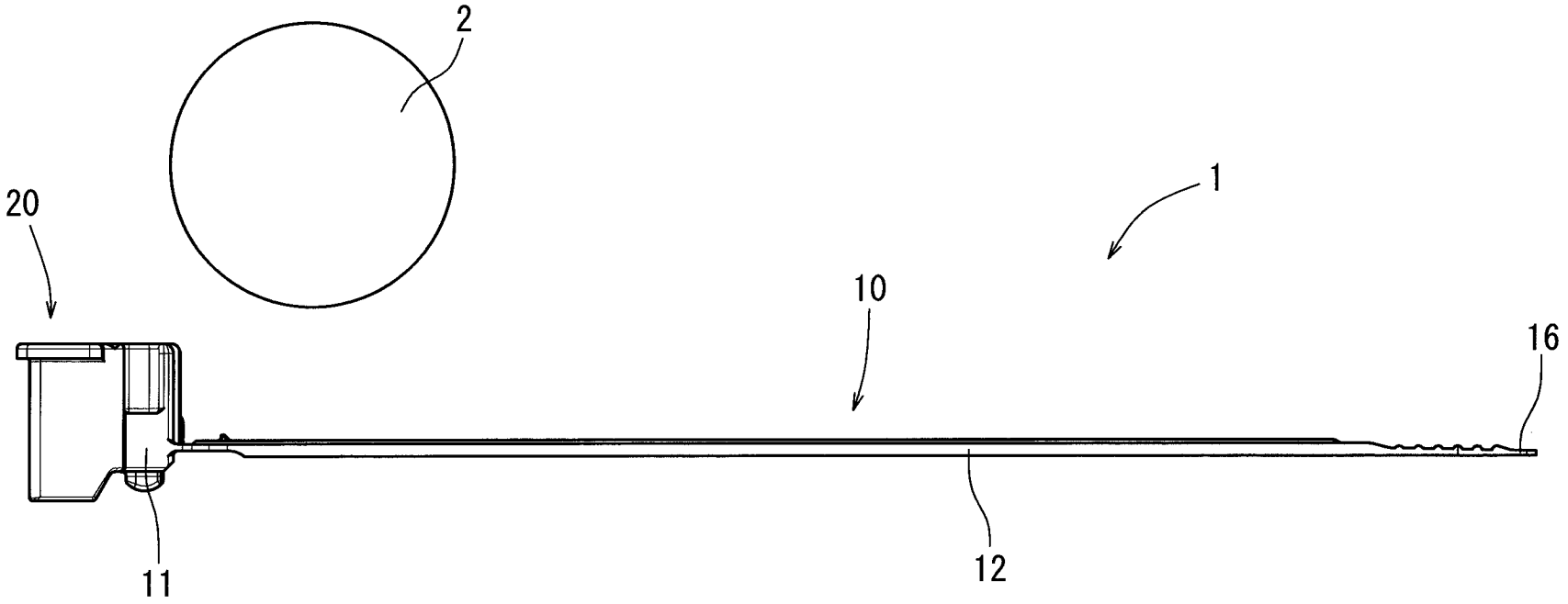
FIG. 5 is a side view of the clip, which shows a condition before a wiring harness is clamped by a holding base of the clip.

Further, as shown in FIGS. 2 and 3, the engagement strips 24 may respectively have edge portions 29 (which may be referred to as second engagement claws) formed on the pressing blocks 25. In particular, the edge portions 29 may respectively be formed on distal (upper) end portions (i.e., end portions farthest from the proximal ends 24*a* of the engagement strips 24) of the inner surfaces 26 of the pressing blocks 25. The edge portions 29 may be simply defined by the inner surfaces 26 and the horizontal end surfaces 28 of the pressing blocks 25. Similar to the engagement claws 27, each of the edge portions 29 may preferably have an arc-shape centered at the center line C of the bolt introduction hole 22. Further, as shown in FIG. 4, the horizontal end surfaces 28 of the pressing blocks 25 may preferably be inclined downward (toward the proximal ends 24*a* of the engagement strips 24) at an angle θ with respect to a line H perpendicular to the center line C of the bolt introduction hole 22. Therefore, the edge portions 29 may be formed into an acute-angled shape in cross section. Further, the angle θ may be appropriately determined based on size and shape of the thread grooves 4*b* of the stud bolt 4.

Figure 9:
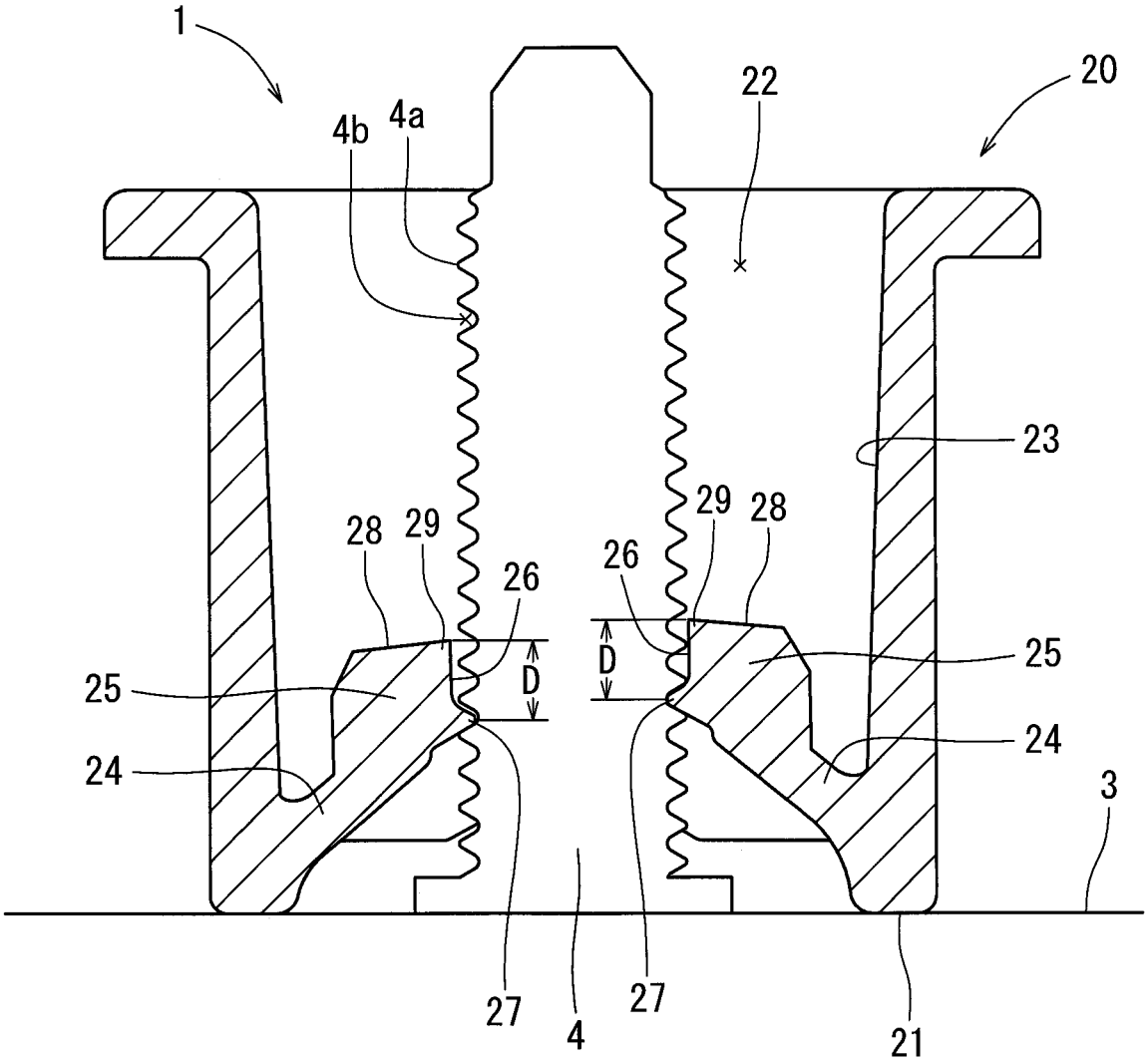
FIG. 9 is a view similar to FIG. 8, which shows a condition in which the bolt is introduced into the bolt introduction hole formed in the connecting base.

The pressing blocks 25 may respectively have a relatively low height. In particular, as shown in FIG. 9, the pressing block 25 may be configured such that a distance D between the engagement claws 27 and the edge portions 29 (i.e., a height of the vertical surfaces 26 of the pressing blocks 25) is substantially equal to a distance twice a pitch of the thread 4*a* (the thread groove 4*b*) of the stud bolt 4.

Figure 6:
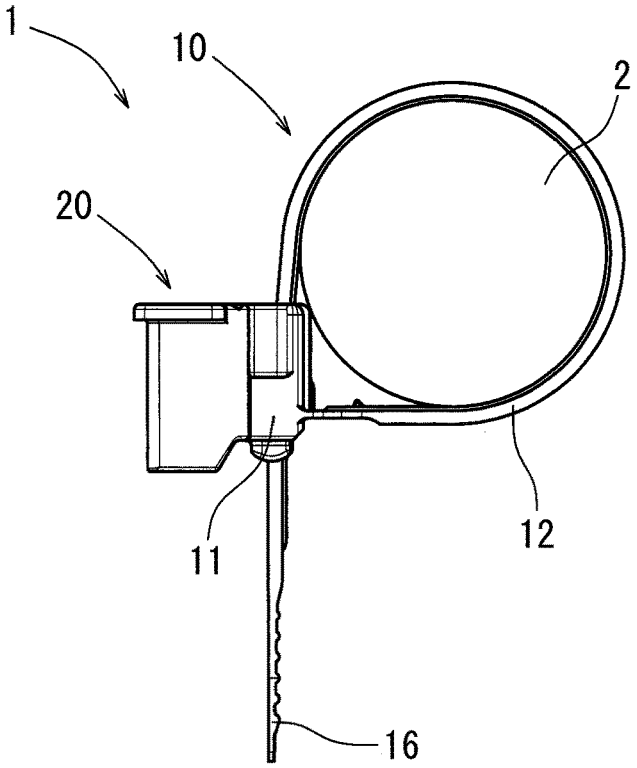
FIG. 6 is a side view of the clip, which shows a condition in which the wiring harness is clamped by a holding base of the clip.
Figure 7:
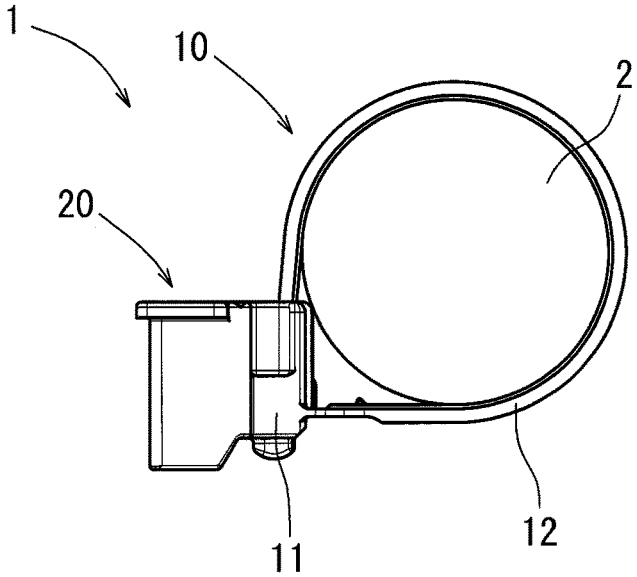
FIG. 7 is a view similar to FIG. 6, which shows a condition in which an excess portion of a belt of the holding base is removed.
Figure 8:
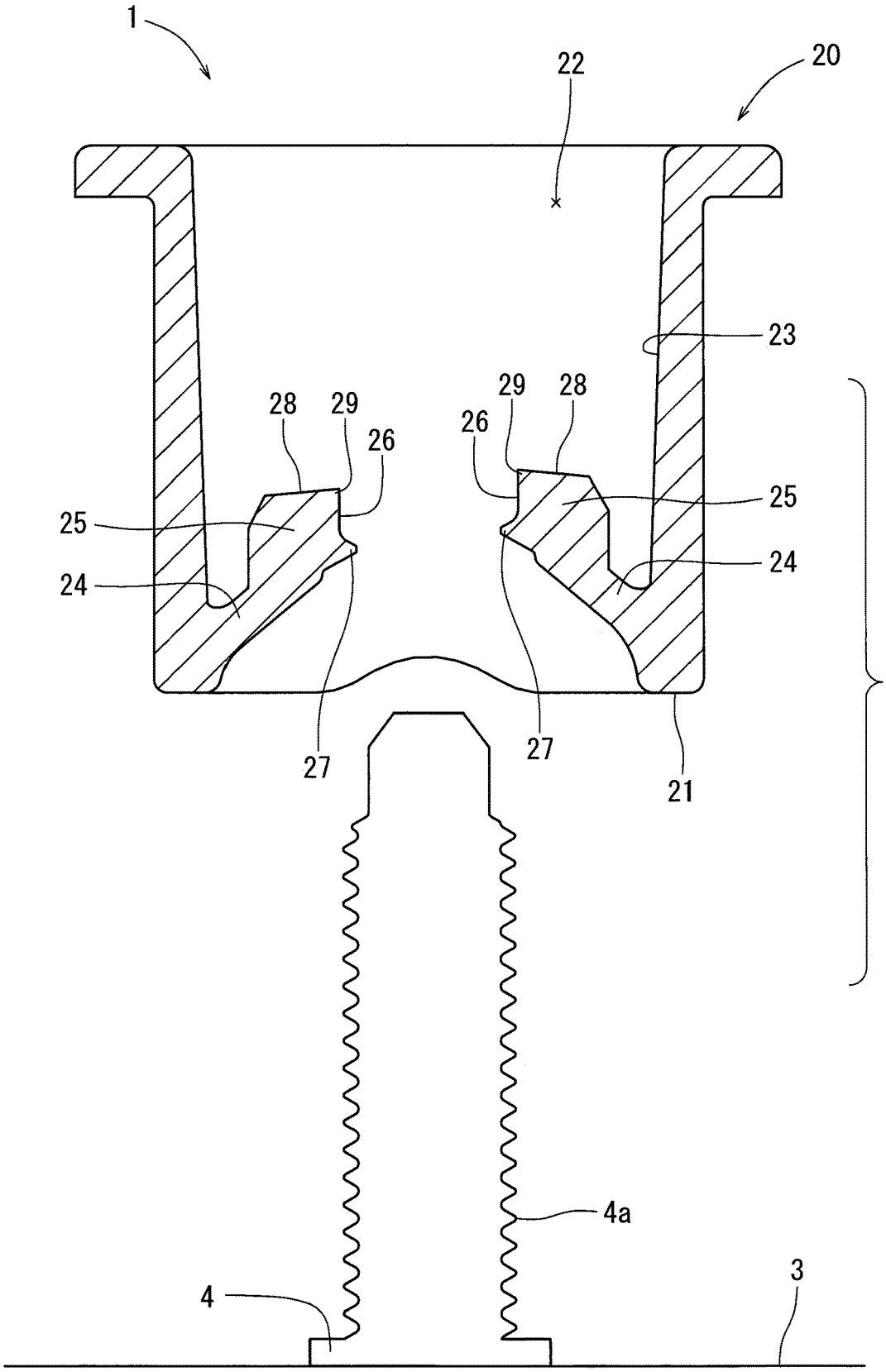
FIG. 8 is a view similar to FIG. 3 shown in combination with a bolt formed on a panel, which shows a condition before the bolt is introduced into a bolt introduction hole formed in a connecting base of the clip.

In order to attach the wiring harness 2 (FIGS. 5 to 7) to the object member 3 using the clip 1, first, the belt 12 of the holding base 10 is looped and wrapped around the wiring harness 2. Thereafter, the belt 12 is inserted into the belt insertion hole 15 of the buckle 11 and is then tightened by pulling a distal end 16 of the belt 12, so as to engage the rack teeth 13 of the belt 12 with the engagement claw 14 of the buckle 11 (FIGS. 1 and 2). Thus, the clip 1 is attached to the wiring harness 2 in a condition in which the wiring harness 2 is clamped or held by the holding base 10 (FIG. 6). Further, as shown in FIG. 7, an excess portion of the belt 12 is removed or cut off using a cutting device (not shown).

Subsequently, the connecting base 20 of the clip 1 is pressed to the stud bolt 4 formed on the object member 3. As a result, the stud bolt 4 is introduced into the bolt introduction hole 22 of the connecting base 20 while oppositely flexing the engagement strips 24 of the connecting base 20 in a direction away from each other due to contact of the thread 4*a* of the stud bolt 4 with the engagement claws 27. When the stud bolt 4 is completely introduced into the bolt introduction hole 22 of the connecting base 20, i.e., when the stud bolt 4 is introduced into the bolt introduction hole 22 until the lower surface 21 of the connecting base 20 contacts the object member 3, the engagement claws 27 of the engagement strips 24 engage predetermined portions (first portions) of the thread groove 4*b* of the stud bolt 4 corresponding thereto, so that the connecting base 20 is coupled to the stud bolt 4. That is, the connecting base 20 is connected to the object member 3 via the stud bolt 4 (FIG. 9), which may be referred to as a connected condition of the connecting base 20. As a result, the clip 1 is attached to the object member 3, which may be referred to as an attached condition of the clip 1. Thus, the wiring harness 2 is attached to the object member 3 via the clip 1.

Figure 10:
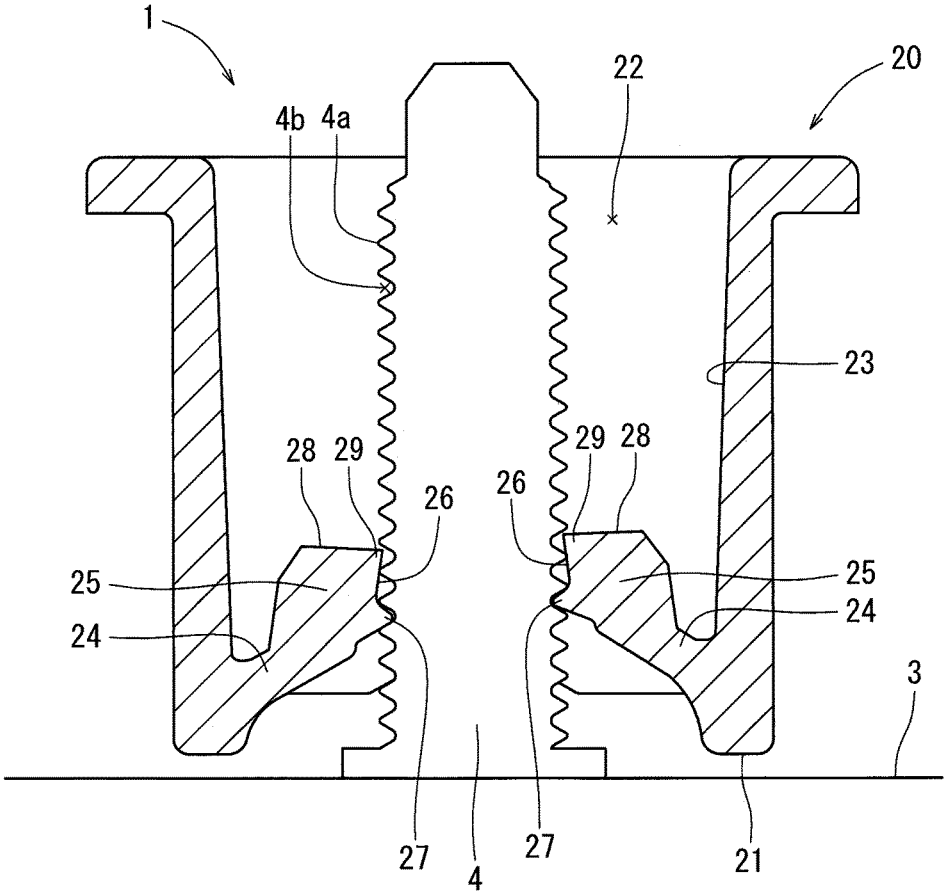
FIG. 10 is a view similar to FIG. 9, which shows a condition in which an extraction force is applied to the clip.
Figure 11:
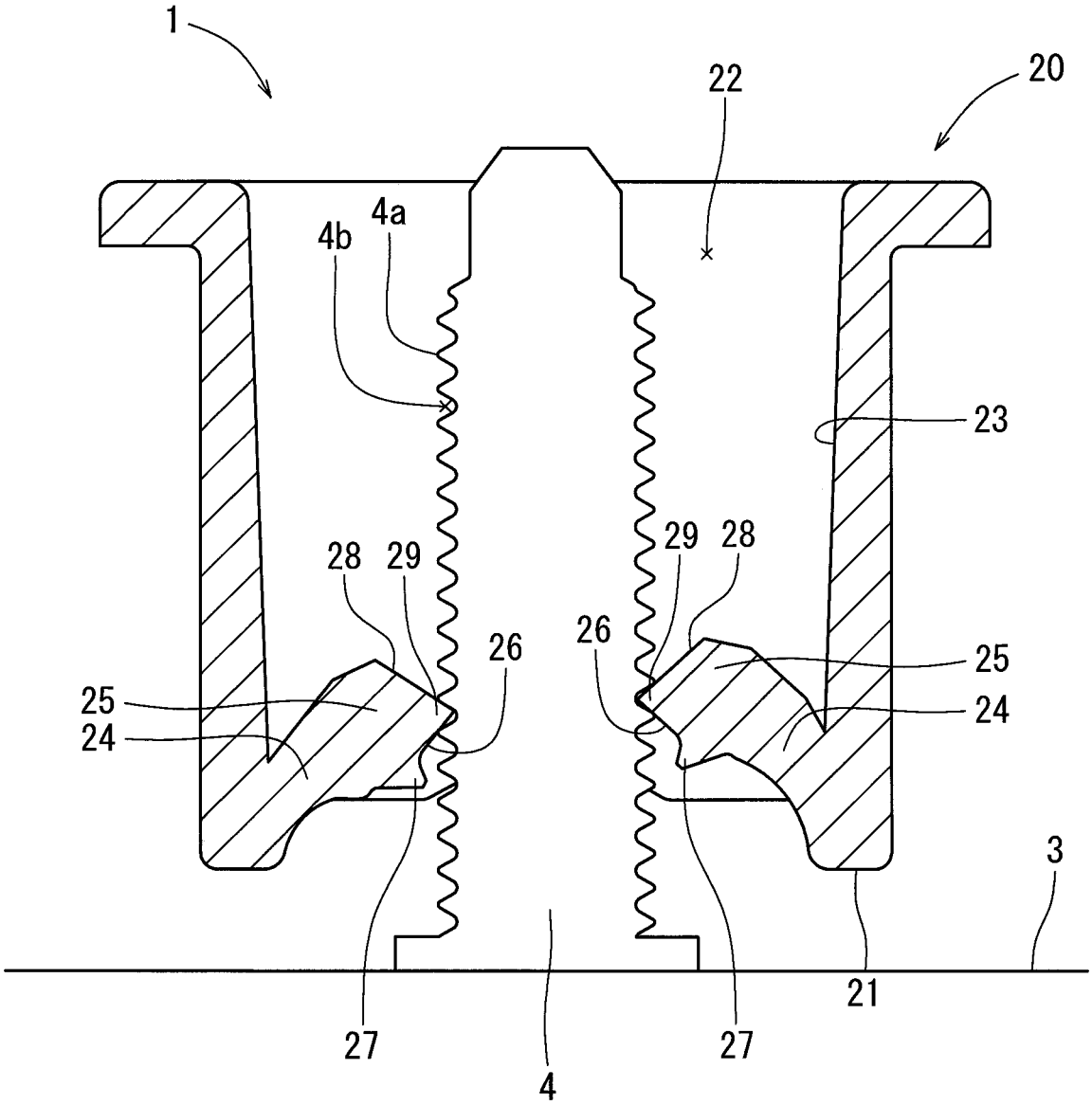
FIG. 11 is a view similar to FIG. 10, which shows a condition in which the extraction force is successively applied to the clip.

When an extraction force (load) is applied to the connecting base 20 (the clip 1) in a condition in which the clip 1 is attached to the object member 3, the engagement strips 24 of the connecting base 20 are oppositely flexed in a direction toward each other due to contact of the engagement claws 27 with the thread 4*a* of the stud bolt 4 (FIG. 10). Further, the extraction force is successively applied to the connecting base 20 of the clip 1, the engagement strips 24 are compressed or deformed while being flexed in the direction toward each other. As a result, the engagement claws 27 of the engagement strips 24 are disengaged from the corresponding portions of the thread groove 4*b* (FIG. 11). However, at the same time as disengagement of the engagement claws 27, the edge portions 29 of the engagement strips 24 engage different portions (second portions) of the thread groove 4*b* corresponding thereto, i.e., portions of the thread groove 4*b* that are positioned away from the predetermined portions corresponding to the engagement claws 27 in a direction toward a distal end of the stud bolt 4. Further, the edge portions 29 may reliably engage the thread groove 4*b* of the stud bolt 4 due to the acute-angled shape in cross section. Therefore, the connecting base 20 remains coupled to the stud bolt 4. As a result, the connecting base 20 remains connected to the object member 3 via the stud bolt 4 (FIG. 11). That is, the connecting base 20 is prevented from being separated from the object member 3 even if the engagement claws 27 are disengaged from the corresponding portions of the thread groove 4*b* of the stud bolt 4. As a result, the clip 1 is prevented from being separated from the object member 3. That is, the wiring harness 2 is prevented from being separated from the object member 3.

As previously described, the distance D between the engagement claws 27 and the edge portions 29 may be determined to substantially be equal to the distance twice the pitch of the thread 4*a* (the thread groove 4*b*) of the stud bolt 4 (FIG. 9). Therefore, the portions of the thread groove 4*b* corresponding to the edge portions 29 may be next portions but one to the predetermined portions of the thread groove 4*b* corresponding to the engagement claws 27 in the direction toward the distal end of the stud bolt 4 (FIGS. 10 and 11).

Figure 12:
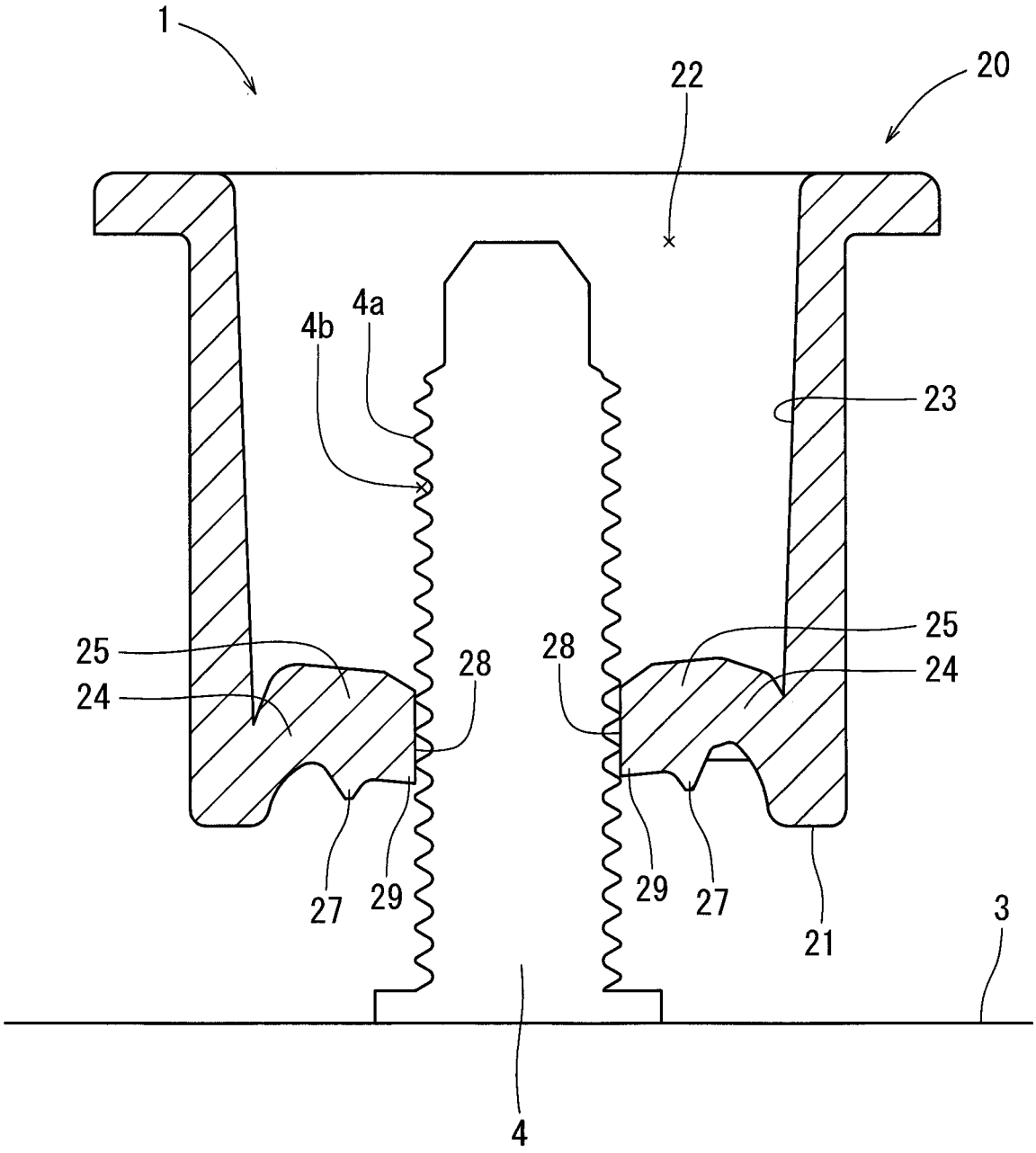
FIG. 12 is a view similar to FIG. 11, which shows a condition in which an excessive extraction force is applied to the clip.

Further, when an extremely large or excessive extraction force is applied to the connecting base 20 of the clip 1 in a condition in which the edge portions 29 of the engagement strips 24 engage the corresponding portions of the thread groove 4*b* of the stud bolt 4 (FIG. 11), the engagement strips 24 are further compressed or deformed while being oppositely flexed in the direction toward each other. As a result, the edge portions 29 are ultimately disengaged from the corresponding portions of the thread groove 4*b* (FIG. 12). Thus, the connecting base 20 is removed from the stud bolt 4, so as to be separated from the object member 3. As a result, the clip 1 is separated from the object member 3, so that the wiring harness 2 is separated from the object member 3.

Figure 13:
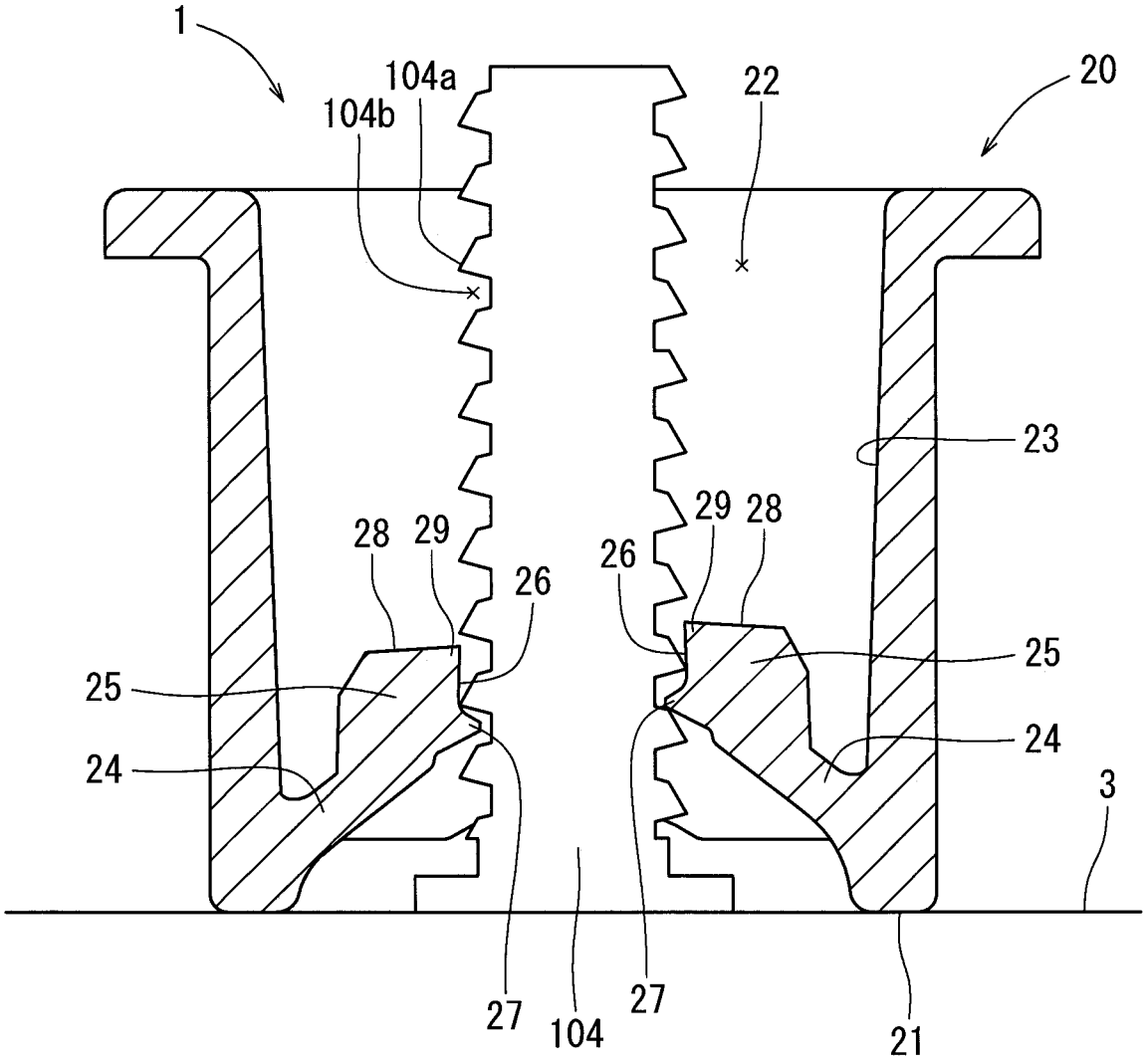
FIG. 13 is a view similar to FIG. 9 in which the bolt is replaced with a first modified bolt.

Further, in the embodiment, the stud bolt 4 having an outer diameter of 5 mm (M5) is exemplified as the bolt member to which the clip 1 is applied. However, as shown in FIG. 13, the bolt member may be a different type of stud bolt 104 having an outer diameter of 5 mm (ϕ5). The stud bolt 104 may be different from the stud bolt 4 in that the stud bolt 104 has a thread 104*a* and a thread groove 104*b* that are different from the thread 4*a* and the thread groove 4*b* in shape and pitch. Even when the clip 1 is applied to the stud bolt 104, the clip 1 may function in the substantially same manner as when it is applied to the stud bolt 4. However, in such a case, when the engagement claws 27 of the engagement strips 24 are disengaged from corresponding portions of the thread groove 104*b* of the stud bolt 104 due to the extraction force applied to the connecting base 20, the edge portions 29 may engage next portions to the portions of the thread groove 104*b* corresponding to the engagement claws 27. In this case, the distance D between the engagement claws 27 and the edge portions 29 may substantially be equal to a distance once (equivalent to) a pitch of the thread 104*a* (the thread groove 104*b*) of the stud bolt 104.

Figure 14:
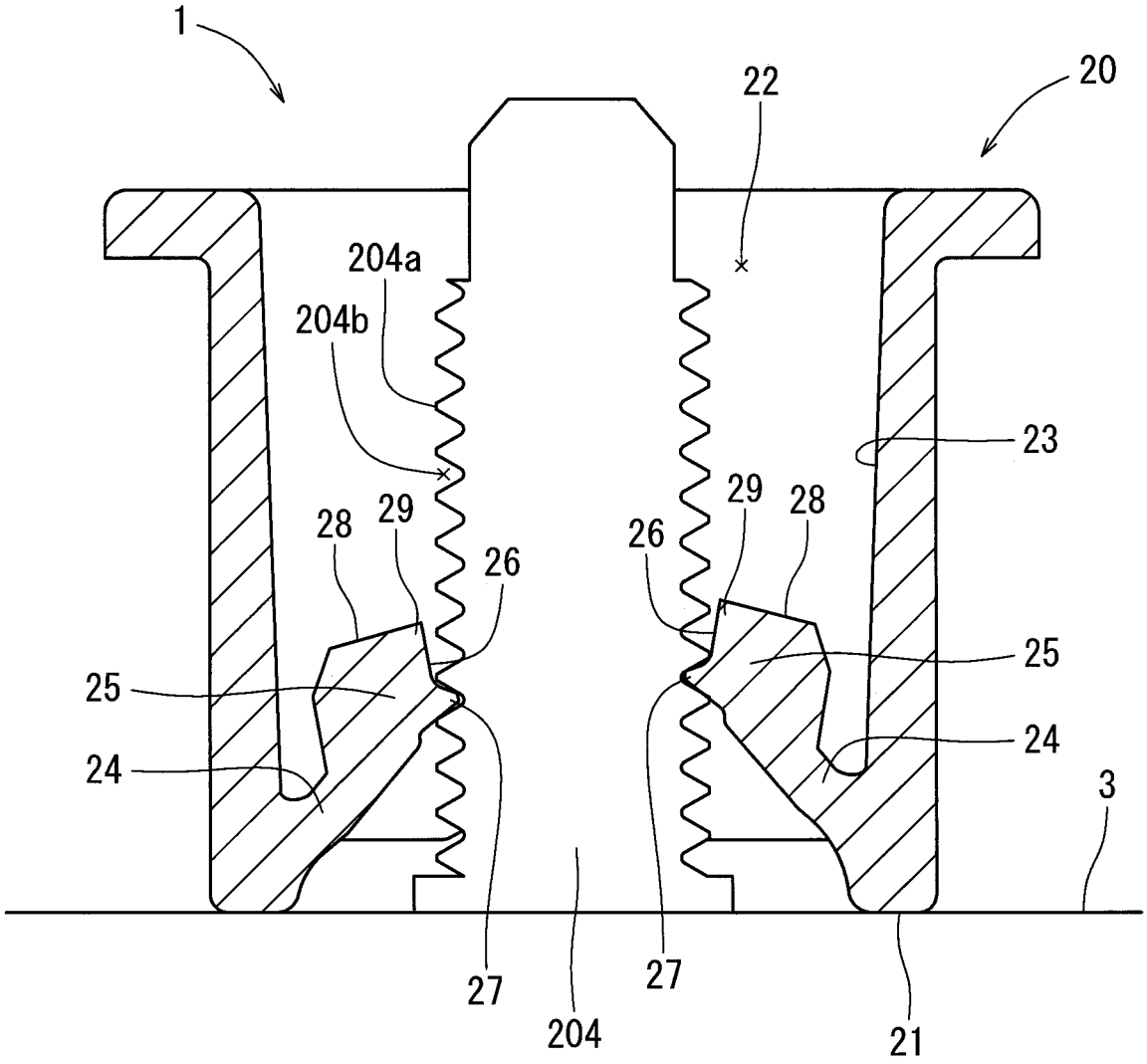
FIG. 14 is a view similar to FIG. 9 in which the bolt is replaced with a second modified bolt.

Further, as shown in FIG. 14, the bolt member may be a standard stud bolt 204 having an outer diameter of 6 mm (M 6). The stud bolt 204 may be different from the stud bolt 4 in that the stud bolt 204 has a thread 204*a* and a thread groove 204*b* that are substantially different from the thread 4*a* and the thread groove 4*b* in thread height and pitch. Even when the clip 1 is applied to the stud bolt 204, the clip 1 may function in the substantially same manner as when it is applied to the stud bolt 4. In this case, when the engagement claws 27 of the engagement strips 24 are disengaged from corresponding portions of the thread groove 204*b* of the stud bolt 204 due to the extraction force applied to the connecting base 20, the edge portions 29 may engage next portions but one to the portions of the thread groove 204*b* corresponding to the engagement claws 27. In this case, the distance D between the engagement claws 27 and the edge portions 29 may be slightly smaller than a distance twice a pitch of the thread 204*a* (the thread groove 204*b*) of the stud bolt 204.

Figure 15:
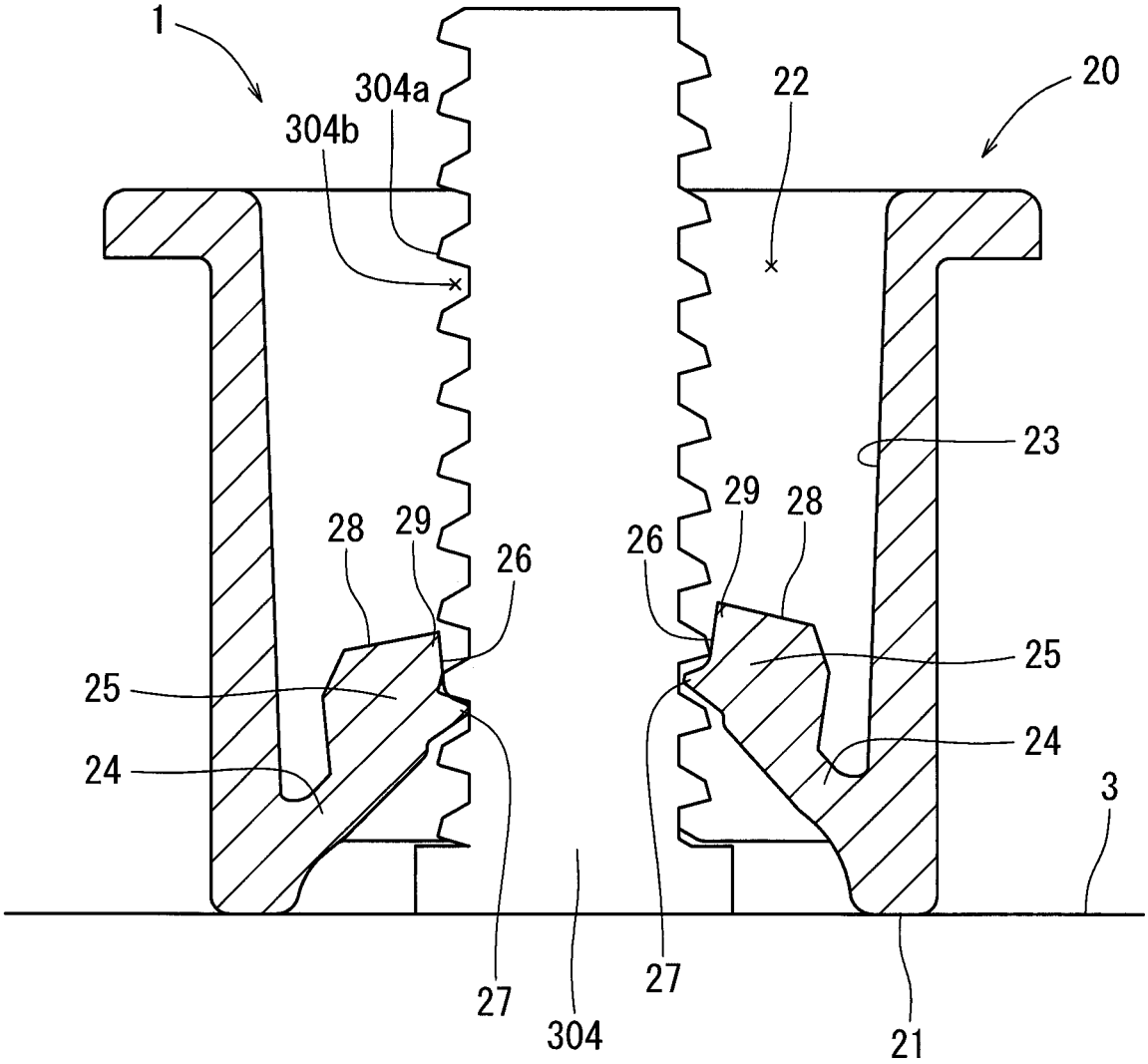
FIG. 15 is a view similar to FIG. 9 in which the bolt is replaced with a third modified bolt.
Figure 16:
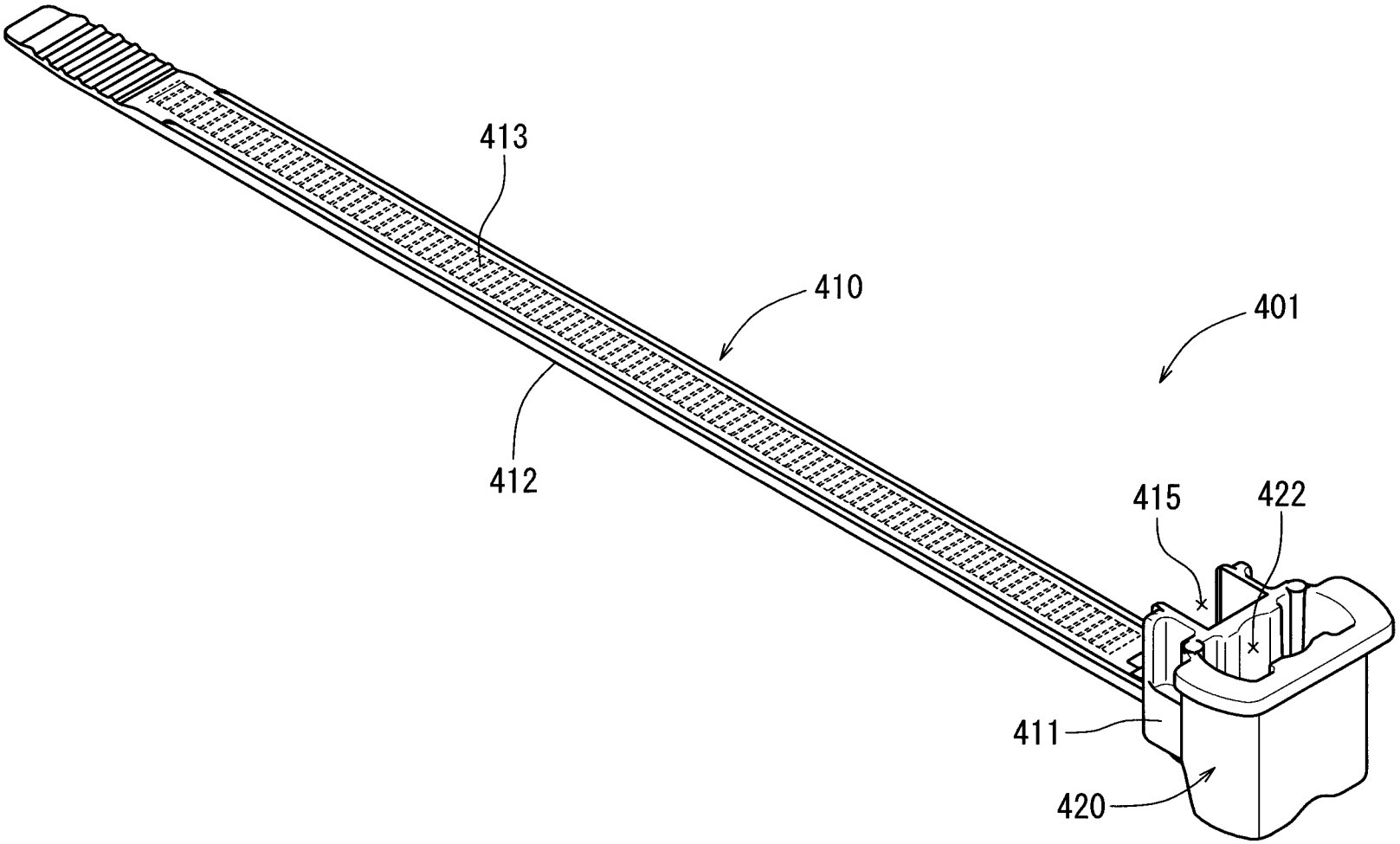
FIG. 16 PRIOR ART
FIG. 16 is a perspective view of a conventional clip.
Figure 17:
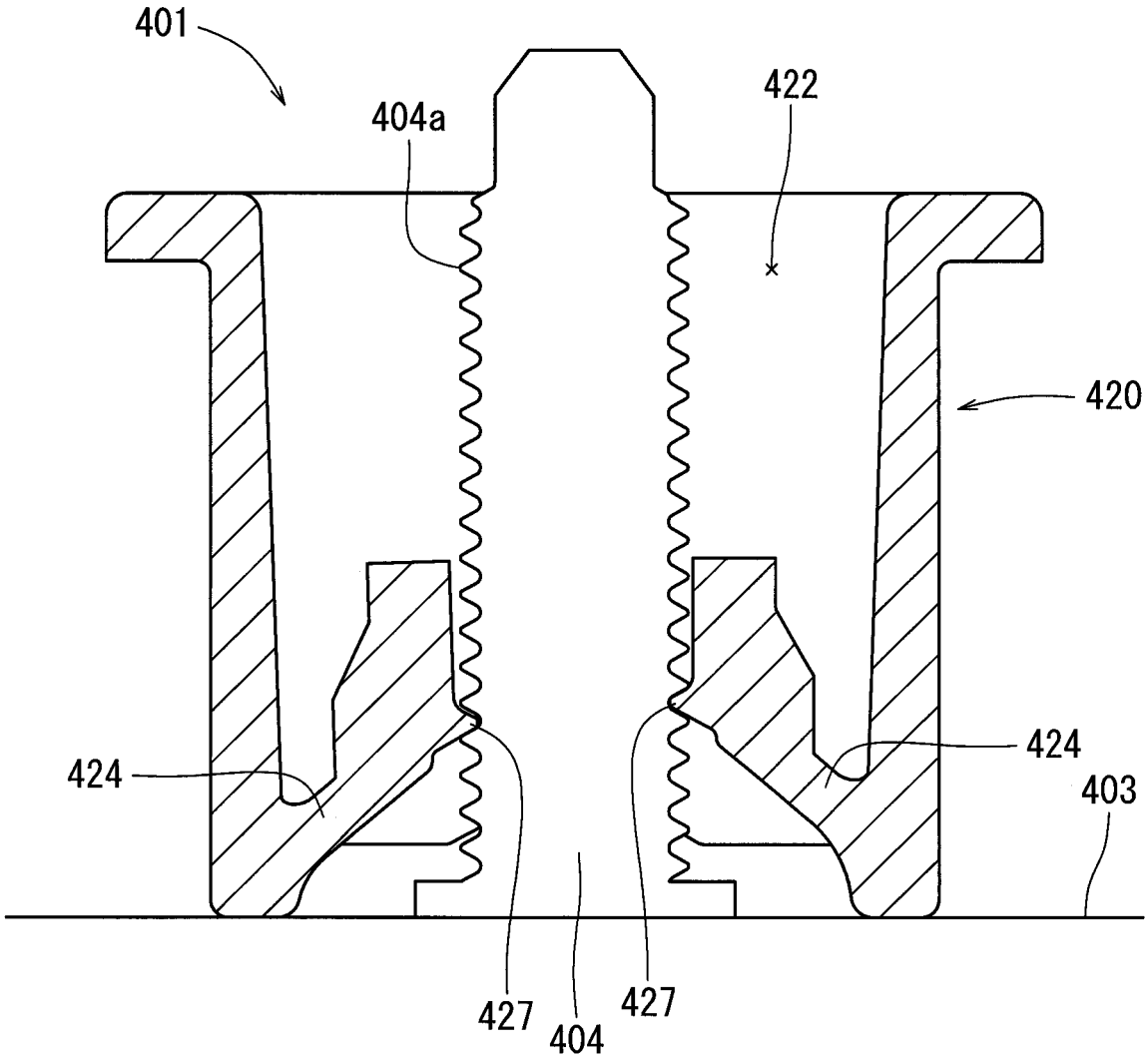
FIG. 17 PRIOR ART
FIG. 17 is a vertical cross-sectional view of the clip, which shows a condition in which a bolt formed on a panel is introduced into a bolt introduction hole formed in a connecting base of the clip.
Figure 18:
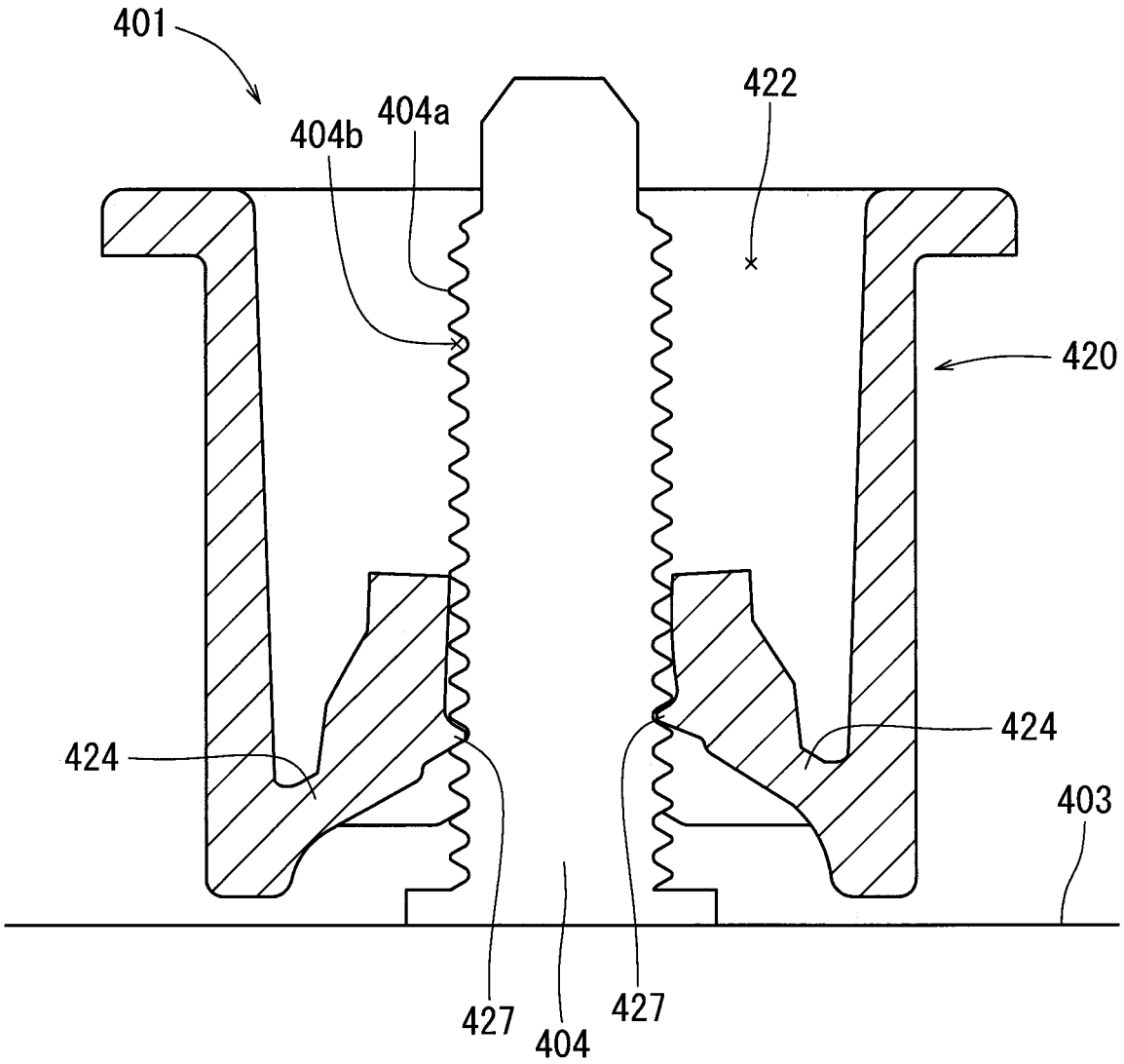
FIG. 18 PRIOR ART
FIG. 18 is a view similar to FIG. 17, which shows a condition in which an extraction force is applied to the clip.
Figure 19:
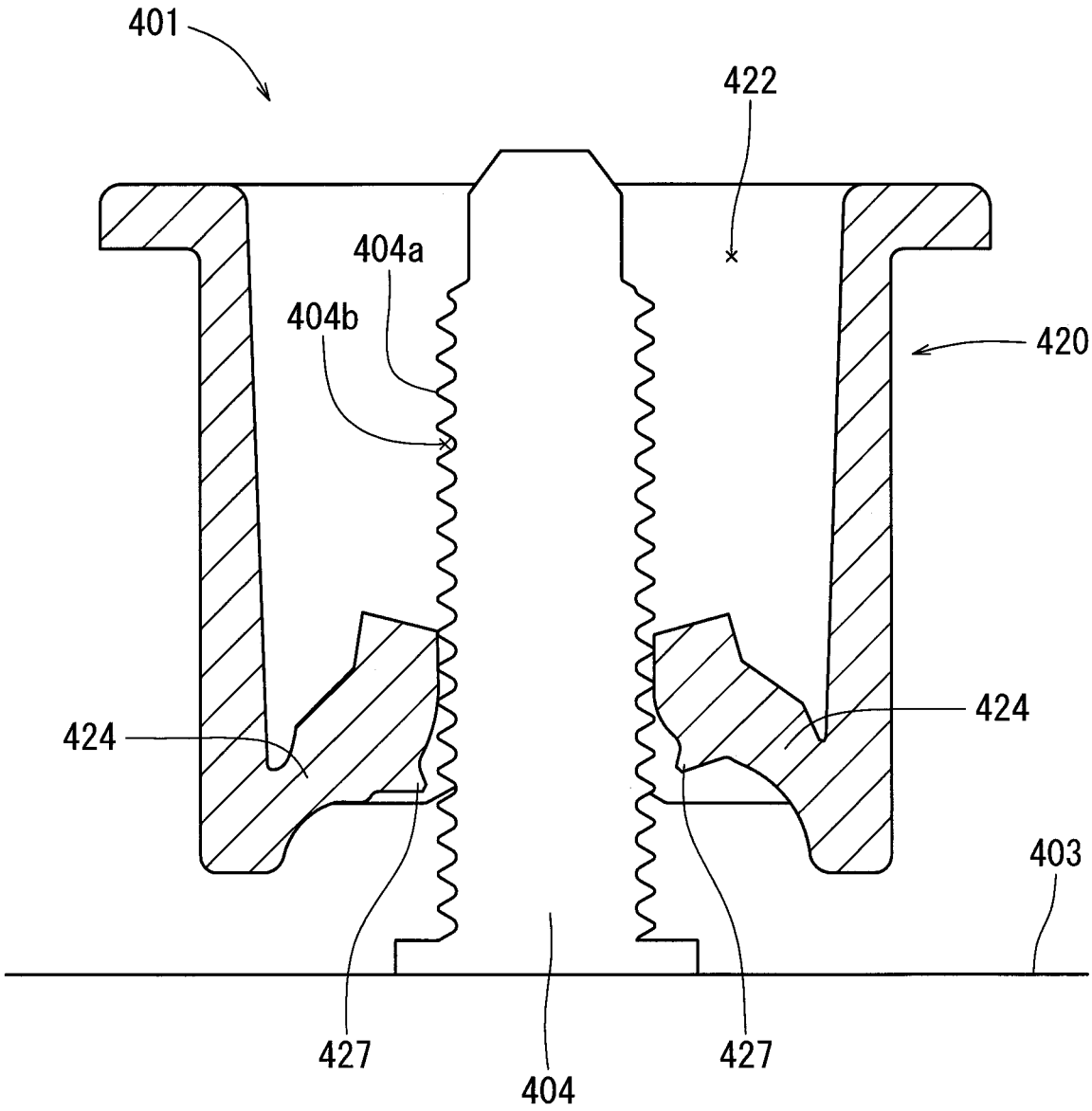
FIG. 19 PRIOR ART
FIG. 19 is a view similar to FIG. 18, which shows a condition in which the extraction force is successively applied to the clip.

Further, as shown in FIG. 15, the bolt member may be a different type of stud bolt 304 having an outer diameter of 6 mm (φ6). The stud bolt 304 may be different from the stud bolt 4 in that the stud bolt 304 has a thread 304*a* and a thread groove 304*b* that are different from the thread 4*a* and the thread groove 4*b* in shape and pitch. Even when the clip 1 is applied to the stud bolt 304, the clip 1 may function in the substantially same manner as when it is applied to the stud bolt 4. However, when the engagement claws 27 of the engagement strips 24 are disengaged from corresponding portions of the thread groove 304*b* of the stud bolt 304 due to the extraction force applied to the connecting base 20, the edge portions 29 may engage next portions to the portions of the thread groove 304*b* corresponding to the engagement claws 27. In this case, the distance D between the engagement claws 27 and the edge portions 29 may substantially be equal to a distance once (equivalent to) a pitch of the thread 304*a* (the thread groove 304*b*) of the stud bolt 304.

Naturally, various changes and modifications may be made to the embodiment. For example, in the embodiment, a pair of engagement strips 24 are formed in the bolt introduction hole 22. However, a two or three pairs of engagement strips 24 may be formed on the inner surface 23 of the connecting base 20.

A representative example of the present disclosure has been described in detail with reference to the attached drawings. This detailed description is merely intended to teach a person of skill in the art further details for practicing preferred aspects of the present disclosure and is not intended to limit the scope of the disclosure. Only the claims define the scope of the claimed disclosure. Therefore, combinations of features and steps disclosed in the foregoing detailed description may not be necessary to practice the disclosure in the broadest sense, and are instead taught merely to particularly describe detailed representative examples of the disclosure. Moreover, the various features taught in this specification may be combined in ways that are not specifically enumerated in order to obtain additional useful embodiments of the present disclosure.

What is claimed is:

1. A clip, comprising:

a holding base configured to hold an attaching article; and a connecting base integrated with the holding base and including a bolt introduction hole that is configured such that a bolt member formed on an object member is introduced thereinto, wherein the connecting base includes flexible engagement strips formed on an inner surface thereof and having pressing blocks formed on distal ends thereof, wherein the engagement strips are oppositely projected from the inner surface of the connecting base toward a center of the bolt introduction hole, wherein the pressing blocks respectively include engagement claws formed on proximal end portions of inner surfaces thereof and configured to engage predetermined portions of a thread groove of the bolt member when the bolt member is introduced into the bolt introduction hole, wherein when the bolt member is introduced into the bolt introduction hole, the engagement claws engage the predetermined portions of the thread groove of the bolt member, so that the connecting base is connected to the object member, wherein in a connected condition in which the connecting base is connected to the object member, when the engagement strips are flexed due to an extraction force applied to the connecting base, thereby disengaging the engagement claws from the predetermined portions of the thread groove of the bolt member, in place of the engagement claws, edge portions formed on distal end portions of the inner surfaces of the pressing blocks engage different portions of the thread groove of the bolt member that are positioned away from the predetermined portions of the thread groove corresponding to the engagement claws in a direction toward a distal end of the bolt member, and wherein a distance between the engagement claw and the edge portion of each pressing block is equal to approximately once or twice a thread pitch of the bolt member.

2. The clip as described in claim 1, wherein the pressing blocks respectively include end surfaces, and wherein the end surfaces are inclined downward at an angle with respect to a line perpendicular to the center of the bolt introduction hole.

3. The clip as described in claim 1, wherein the edge portions of the pressing blocks do not engage portions of the thread groove of the bolt member when the connecting base is in the connected condition.

4. The clip as described in claim 1, wherein the edge portions of the pressing blocks do not engage portions of the thread groove of the bolt member when in the connected condition and prior to the engagement strips being flexed due to the extraction force being applied to the connecting base.

5. The clip as described in claim 1, wherein:

the pressing blocks each include an end surface, and the edge portions are defined by the inner surfaces and the end surfaces of the pressing blocks.

6. A clip, comprising:

a holding base configured to hold an attaching article; and a connecting base configured to be coupled to a bolt member formed on an object member, wherein the connecting base includes a bolt introduction hole formed thereon and configured such that the bolt member is introduced thereinto, and engagement strips flexibly formed on an inner surface thereof and having pressing blocks that are formed on distal ends thereof, wherein the engagement strips are oppositely projected from the inner surface of the connecting base toward a center of the bolt introduction hole, wherein the pressing blocks respectively include inner surfaces facing to each other, engagement claws formed on proximal end portions of the inner surfaces thereof and projecting toward each other, and edge portions formed on distal end portions of the inner surfaces, wherein the pressing blocks are configured such that the engagement claws engage predetermined portions of a thread groove of the bolt member and the proximal ends do not engage portions of the thread groove of the bolt member when the bolt member is introduced into the bolt introduction hole, and wherein a distance between the engagement claw and the edge portion of each pressing block is configured to substantially be equal to a distance between once and twice a thread pitch of the bolt member.

7. The clip as described in claim 6, wherein:

the engagement claws are projected from the inner surfaces of the pressing blocks, and the edge portions are not projected from the inner surfaces of the pressing blocks.

8. The clip as described in claim 6, wherein:

the pressing blocks each include an end surface, and the edge portions are defined by the inner surfaces and the end surfaces of the pressing blocks.

* * * * *